US005655596A

United States Patent [19]

Zaoralek

[11] Patent Number: 5,655,596

[45] Date of Patent: Aug. 12, 1997

[54] STEAM-HEATED ROLL

[75] Inventor: Heinz-Michael Zaoralek, Königsbronn, Germany

[73] Assignee: Schwabische Huttenwerke GambH, Wasseralfingen, Germany

[21] Appl. No.: 553,515

[22] PCT Filed: Feb. 6, 1995

[86] PCT No.: PCT/EP95/00420

§ 371 Date: Apr. 1, 1996

§ 102(e) Date: Apr. 1, 1996

[87] PCT Pub. No.: WO95/23950

PCT Pub. Date: Sep. 8, 1995

[30] Foreign Application Priority Data

Mar. 4, 1994 [DE] Germany ..... 44 07 239.2

[51] Int. Cl.[6] ..... F28D 11/02

[52] U.S. Cl. ..... 165/90; 165/89; 492/46; 432/246

[58] Field of Search ..... 165/89, 90; 492/46; 432/246

[56] References Cited

U.S. PATENT DOCUMENTS

| | | | |
|---|---|---|---|
| 4,658,486 | 4/1987 | Schönemann | 492/46 |
| 4,955,433 | 9/1990 | Zaoralek | 165/89 |
| 4,964,202 | 10/1990 | Pau et al. | 492/46 X |
| 5,072,497 | 12/1991 | Zaoralek et al. | 29/123 |
| 5,152,333 | 10/1992 | Barbe et al. | 492/46 X |

FOREIGN PATENT DOCUMENTS

| | | | |
|---|---|---|---|
| 720913 | 6/1931 | France . | |
| 1541670 | 4/1967 | France . | |
| 0683932 | 11/1939 | Germany | 492/46 |
| 24 52 734 | 5/1975 | Germany . | |
| 32 47 239 | 7/1983 | Germany . | |
| 33 21 122 | 12/1983 | Germany . | |
| 32 42 066 | 5/1984 | Germany . | |
| 38 19 391 | 1/1989 | Germany . | |
| 38 38 726 | 5/1990 | Germany . | |
| 90 00 980 | 6/1990 | Germany . | |
| 39 25 367 | 2/1991 | Germany . | |
| 40 02 530 | 8/1991 | Germany . | |
| 40 36 121 | 1/1992 | Germany . | |
| 90 14 117 | 3/1992 | Germany . | |
| 42 03 550 | 8/1993 | Germany . | |
| 93 06 176 | 8/1993 | Germany . | |
| 43 17 873 | 10/1993 | Germany . | |
| 629385 | 9/1949 | United Kingdom . | |

OTHER PUBLICATIONS

International Search Report.

*Primary Examiner*—John Rivell
*Assistant Examiner*—Christopher Atkinson
*Attorney, Agent, or Firm*—Ratner & Prestia

[57] ABSTRACT

The invention relates to a steam-heated roll and a roll body having a central bore and peripheral axially parallel drilled passages for guiding the steam, and having at least one bolted-on flange pin with a central bore and connecting passages between the central bore of the flange pin and the ports of the peripheral drilled passages of the roll body at the flange pin, which is characterized by the connecting passages branching from the central bore of the flange pin in the flange pin to a plurality of ports of the peripheral drilled passages.

20 Claims, 4 Drawing Sheets

STEAM-HEATED ROLL

FIELD OF THE INVENTION

The invention relates to a steam-heated roll of the kind as described in the preamble of claim 1.

BACKGROUND OF THE INVENTION

For the treatment of web-like media, such as e.g. paper, by pressing, drying and smoothing, rolls are used which have large diameters and are heated. In this context "large" is appreciated to be a diameter of at least 1,000 mm.

These involve e.g. the so-called "center rolls" of a press section of a paper machine, the usual drying cylinders in the drying section and particularly the heated rolls in smoothing sections, the so-called "gloss cylinders" and "soft calenders". The so-called "Yankee cylinder" represents a special case, a combination of drying cylinder and smoothing roll.

Heating such rolls is done preferably from within by means of heat transfer fluids, preferably water, steam or heat transfer oil. The increase in the surface temperature of the rolls achieved thereby permits either their function, by affecting in the case of drying cylinders the evaporation of the moisture in the paper web, or promotes their function, because the water in the press can be more easily squeezed out from the paper web at elevated temperature and reduced viscosity or because the plastification ability of the paper fibers is enhanced at elevated temperature so that they can be smoothed more easily.

When heating is done by means of steam, the rolls are normally of the cylindrical kind. The steam is usally introduced into the interior of the roll cylinder where it condenses on the inside surfaces. The condensate is drawn off from the roll via a syphon.

The drawback in this arrangement is that in such a configuration the complete interior space is subjected to steam pressure. This results in restrictions mainly stemming from safety considerations. These relate to the level of the permissible steam pressure and thus to the achievable surface temperature which, in turn, restricts the effectiveness of the process. Restrictions also exist—depending on where employed—as regards the application of roll materials. Since, for instance in U.S.A. the so-called chilled cast iron, as is usually employed for a smoothing roll, is not standardized, it is out of the question for such applications. Large rolls for gloss calenders thus need to be manufactured from gray cast iron or nodular cast iron which as regards the wearing properties of the roll surface is unfavorable.

Due to the mechanical stresses the wall of the roll cannot be designed as thin as would be desirable for a good conduction of the thermal energy to the heat transfer medium.

When certain rotative speeds are attained, a stable ring of condensate is formed on the inside of the roll due to the centrigugal effect and dependent on the roll diameter. Then, the steam no longer condenses on the wall of the roll, but in the condensate ring. This results in a deterioration, on the one hand, of the heat transfer from the steam to the roll, but also, on the other, of the temperature profile at the roll surface.

Some of the cited drawbacks, such as e.g. the poor temperature profile, were overcome in the case of cylindrical rolls by changing to hot water for the heating. For this purpose a cylindrical displacement body was secured in the central bore of the roll so that a narrow, ring-shaped gap remained between the displacement body and the inner bore.

The hot water was then forced through this gap at velocities exceeding 1 m/s.

The drawbacks of the large wall thickness, required for mechanical reasons, and the restriction due to the internal pressures remained, however, and apart from this such rolls are of a heavy-weight structure.

The aforementioned drawbacks were overcome in part by the so-called peripherally drilled rolls. In this case the heat transfer fluid—water or heat transfer oil—flows through axially parallel drilled passages located just beneath the surface of the roll. This enabled the distance for conducting the heat from the heat transfer medium to the surface of the roll to be decisively reduced.

Unfortunately, this design too has several drawbacks. For safety reasons water is used only up to a water temperature of max. 170° C. In addition to this, heat transfer oil is used. The latter is accepted by paper mills merely as a necessary evil. Even minor leakage in pumps, sealing heads or in the mechanically highly stressed rolls are a considerable nuisance. Handling the oil by pump transfer or other procedures always involves a possible hazard for the environment.

The volume of liquid needing to be pumped is also a problem in the case of large rolls. In flowing through the roll the heat transfer medium gives off part of its heat to the roll, it thereby losing temperature. For reasons of an homogenous surface temperature only a limited drop in temperature of the heat transfer medium is permissible. This is the reason why—depending on the heating capacity of the roll—the liquid throughput needs to be selected correspondingly high. The higher this is selected, the lower is the drop in temperature.

For a heated "center roll" roughly 8 m wide a heating capacity of roughly 1,800 kW needs to be assumed according to the publication of one paper machine manufacturer. If such a roll is heated with water, then a throughput of 72 liters/sec. is necessary for a permissible drop in temperature of the water of 6° C. This is still 43 liters/sec. for 10° C.

If such a roll is heated with heat transfer oil, then the throughput increases to roughly twice as much due to the lower specific heat of this heat transfer medium.

It has now been proposed within the scope of the German utility model No. G 93 06 176.5 in the same field to also employ steam as the heat transfer medium in peripherally drilled rolls to thus get round the drawbacks of the water or the heat transfer oil. However, this design poses some problems in the application to large steam-heated rolls in accordance with the proposed principle.

In this case, for instance, it is provided for that the heating steam is introduced from both ends of the roll into the peripheral drilled passages. For this purpose, part of the steam entering through the sealing head into the pin at the heating end is directed through the central bore in the roll body to the other end of the roll and from there into the associated ends of the peripheral drilled passages. Particularly due to the pressure vessel code requirements, this central bore is produced with a diameter that is smaller than 150 min. The rolls concerned then fail to fall under the pertinent code requirements in countries in which the US ASME code requirements apply.

In the case of large rolls, however, this would mean that these rolls need to be designed almost solid. The savings in weight as are possible with an enlarged central bore thus fail to be achieved.

Although it would be possible to incorporate in an enlarged central bore a tube for handling the steam which has an internal diameter that is smaller than 150 mm, the central support of such a tube, taking into account the thermal expansion and vibration in operation, is highly complicated, however.

Also, the distribution of the heating steam, as proposed in this utility model, fails to be achievable in this way when large rolls are concerned. Together with the diameter the number of peripheral drilled passages increases to such an extent that they can no longer be connected individually to the central bore in the pin. Providing any kind of receiver spaces in the pins or in the roll body or between the two is also not allowed, for then the prerequisite for the ASME Code (diameter<150 mm) failing to apply would no longer be satisfied. But even if this were of no importance, receiver spaces, from which the connection to the peripheral drilled passages could be made, would have to be closed off by heavy pressure caps from the interior of the roll, when the latter itself is required to remain pressureless.

New considerations also need to be made for discharging the condensate to be stripped from the peripheral drilled passages of the roll. In case that a syphon becomes completely filled with condensate, the overpressure necessary to strip this syphon is calculated from the resistance of a condensate column from the outer edge of the roll to its center as dictated by the centrifugal force. When such an overpressure is applied, then large quantities of stripping steam will blow through from all other syphons with the corresponding losses. Apart from this, achieving the connection of the individual syphons to the central condensate receiver poses difficulties in design.

In conclusion, returning the resulting condensate to the drive end by a central tube requires a highly complicated design, especially when the latter itself needs to be accommodated in a central steam tube (see above).

SUMMARY OF THE INVENTION

The object of the present invention is to provide a steam-heated roll which overcomes the disadvantages of prior art as cited, particularly in eliminating the need for guiding the steam through the central bore of the roll body and without any substantially weakening of the components due to the steam passages.

This object is achieved by a steam-heated roll which is configured in accordance with the characterizing portion of claim 1.

Expedient embodiments are defined by the features of the subordinate claims.

Figure 1:
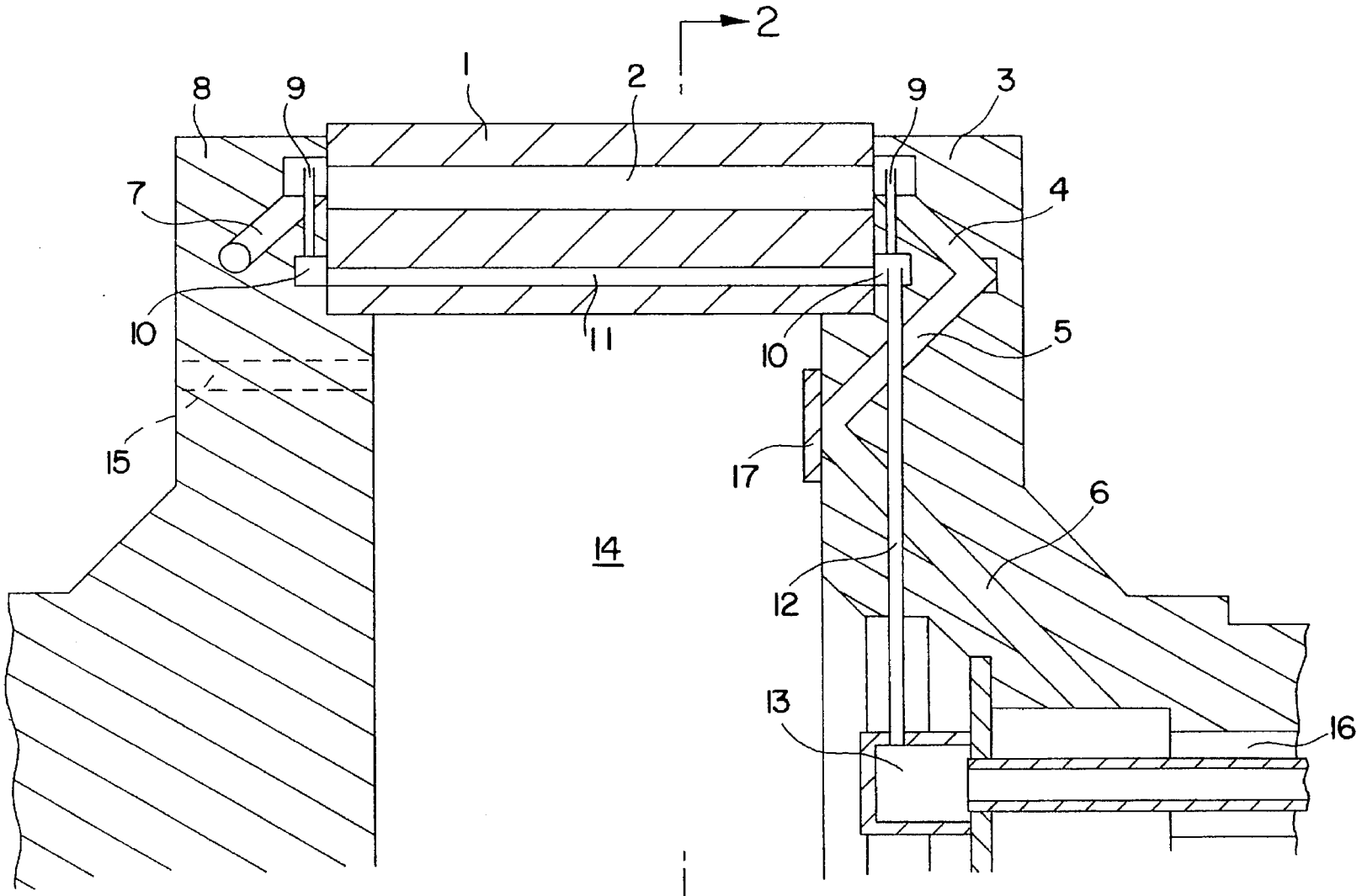
FIG. 1 is a longitudinal partial fragmentary view of a roll according to the present invention.

The advantage of such a roll in accordance with the invention consists particularly in the central bore of the roll body being maintained totally free of heating steam so that there is neither the necessity of maintaining its diameter smaller than 150 mm to satisfy the pertinent code requirements, nor is there any need of measures to prevent the prescribed flow surface area from becoming too large.

A further advanteagous aspect is that due to branching the connecting passages in accordance with the invention it is now possible, without any substantial weakening of the roll body or the flange pins, to distribute the steam to all peripheral drilled passages, especially also in the case of relatively large dimensioned rolls having very many drilled passages.

In accordance with one embodiment of the proposed roll, the latter is configured so that the connecting passages are disposed in a flange pin of the roll at the guide end thereof, which has the advantageous effect that the short flow path for the heating steam to the location where it is required involves only minor loss in heat during transport.

On rolls having flange pins at the guide end thereof, which are unsuitable to accommodate the connecting passages for some reason, e.g. for lack of available space, there is now the possibility of selecting a configuration in which the connecting passages are disposed in a drive-end flange pin of the roll, the supply of the heating steam being made from the operator end of the roll to the drive end via a supply tube arranged centrally in the interior cavity of the roll.

A roll in accordance with the invention may be configured so that the connecting passages branch from the central bore in a first flange pin to every second peripheral drilled passage, whilst the neighboring drilled passages located inbetween are connected by passages in a second flange pin located opposite.

In this way the return of the heating steam to the first flange pin can be assured, the second flange pin receiving merely a minor weakening due to the passages and the roll body itself can remain free of connecting passages and thus unweakened. In this case the quantities of steam in relation to the cross-sections of the peripheral drilled passages are so low that an adequate steam supply is possible at low steam velocities.

In one preferred embodiment a connecting passage is branched from the central bore to four ports of the peripheral drilled passages.

This arrangement permits achieving that especially in the case of large rolls a small number of the connecting passages emanating from the central bore supply four-times the number of peripheral drilled passages. The flange pin is weakened in its central region thereby only to a minor degree, although the steam supply is made possible to all peripheral drilled passages to be heated.

The advantegeous possibility exists of configuring a steam-heated roll in accordance with the invention so that a connecting passage consists of a first drilled passage leading from the central bore of the flange pin to the central bore of the roll, this first drilled passage comprising a plurality of second drilled passages incorporated in the flange pins from the port of said first drilled passage in the central bore of the roll body, and in turn comprising a plurality of drilled passages connecting the ends of said second drilled passages to a plurality of ports of the peripheral drilled passages, the port of said first drilled passage being sealed off from the central bore of the roll body.

By the means as described above, manufacturing the connecting passages is made simple by suitably drilling the flange pin, whilst by a suitable arrangement of the various partial drilled passages of the connecting passages a further branching of said first drilled passage emanating from the central bore is possible. Since the individual drilled passages are freely selectable within relatively broad ranges of the axial and radial angles it can be assured that despite a large number of drilled passages in the peripheral flange area no substantial weakening of the flange occurs. Furthermore, the port of the first drilled passage, emanating from the central bore of the flange and porting on the inside thereof into the central bore of the roll body, is easy to seal off there, because the space required for this purpose in the interior of the roll is not needed for further components and is not pressurized or filled with a medium detrimental to the seals.

Preferably in the region of the ends of the peripheral drilled passages in the flange pin at least one ring-shaped receiver space is provided for the condensate resulting in the drilled passages.

By this configuration it may be assured that the condensate does not collect at unwanted locations in its flow path and interfers with the steam flow and the heat transfer. In addition, central means for discharging the condensate of several peripheral drilled passages may be made available in this way which weaken the roll components to only a minor extent.

In accordance with this the steam-heated roll may be provided with syphons which connect the receiver space—for discharging the condensate collected therein along with any stripping or blow-through steam—to the port regions of the peripheral drilled passages at the ends thereof in the flange pin. This arrangement thus assures a speedy and effective removal of the condensate, the quantity of condensate in the roll remaining exceptionally small.

To maintain the peripheral drilled passages practically totally free of any collecting condensate the receiver spaces in the first and second flange pin may be connected to each other by axially parallel return drilled passages. This permits also a central discharge of the condensate and the stripping or blow-through steam at the end containing the first flange pin.

In a further advantageous embodiment the roll according to the invention is characterized by the receiver space of the flange pin being connected via radial passages to a receiver space in the center of the flange pin for discharging the condensate and any stripping steam, said flange pin being connected in turn via a double sealing head of the central bore to the exterior of the roll.

This radial splitting arrangement in the return of the condensate has the advantage that also the difference in pressure from the peripheral drilled passages to the central bore is split up. Pressure compensation takes place in the receiver spaces. This difference in pressure from this location to the peripheral drilled passages is confronted by a drop in pressure composed of a centrifugal force component and a flow resistance. Should the centrifugal force component become so great that it alone corresponds to the difference in pressure, flow can then no longer take place. This difference in pressure is adjustable by the proposed embodiment in such a way that the resistance to flow in the case of a pure flow of steam is larger than the maximum possible resistance due to the centrifugal force which then materializes when the content of the syphon is pure condensate, i.e. flow no longer being possible. In this way, a stable discharge of water is assured.

Preferably an open connecting passage through a flange pin may connect the central bore of the roll to the environment. This measure ensures that ambient pressure always exists in the roll so that the roll itself is no longer to be viewed as a pressure vessel and the interior space may be designed in the case of a large roll so that relatively thin roll walls are provided, thus producing a roll with light-weight structure.

A roll in accordance with the invention may be configured so that for returning the condensate from the drive-end flange pin a return tube is provided centrally disposed in the interior of the roll. Although this embodiment, as described at the outset, is highly complicated in design, there is sometimes the need for such a means which is achievable at little expense for a roll in accordance with the invention due to the interior of the roll being pressureless.

There is furthermore the possibility of configuring the supply and return tubes disposed centrally in the interior of the roll as a concentric arrangement of tubes, this having the advantage that imbalance of the roll body as a whole may be avoided.

An example embodiment of the steam-heated roll in accordance with the invention will now be described in the following with reference to the attached figures. Therein FIG. 1 shows a longitudinal section through a steam-heated roll having two bolted flanges, and FIG. 2 shows a partial view of a cross-section through a sector of the right-hand flange of the roll illustrated in FIG. 1.

Figure 2:
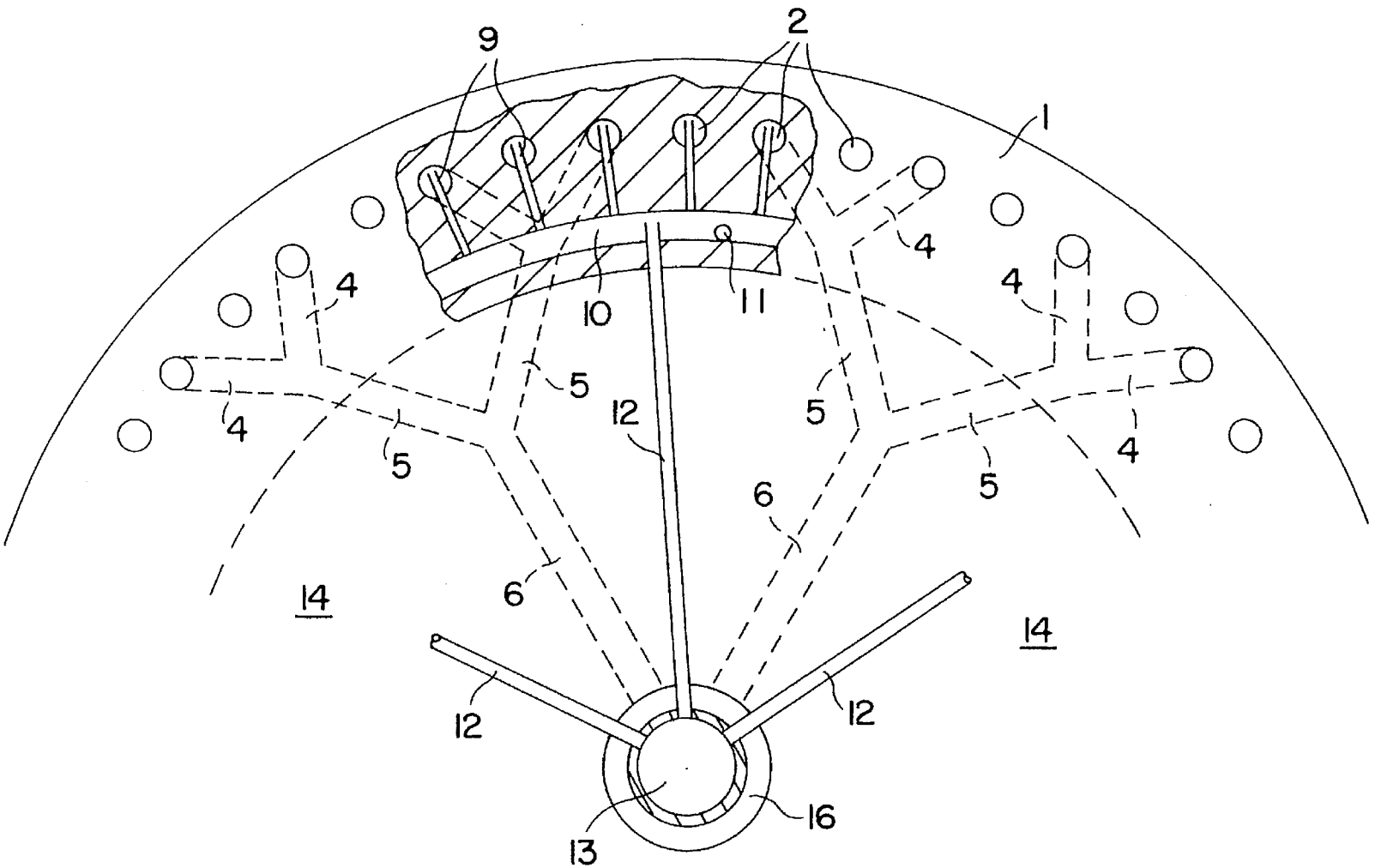
FIG. 2 is a view taken along lines 2—2 of FIG. 1.

The roll illustrated in FIGS. 1 and 2 is driven at the flange 8 shown on the left in FIG. 1. On such rolls a distinction needs to be made between the pin or flange 3 at the guide end and having a double sealing head for the steam supply and the condensate discharge and the pin or flange 8 at the drive end.

All connecting passages for the steam are accommodated according to the invention as drilled passages 4, 5 and 6 in the pin or flange 3 at the guide end. To eliminate largish distribution spaces the drilled passages are branched like that of a tree. Should e.g. the 48 peripheral drilled passages of a roll having an outer diameter of 1850 mm be supplied with steam, which enters through the central bore 16 of the pin, then initially six radial drilled passages inclined inwardly connect this central bore to the inner flange surfaces. From each outlet port at this location two blind holes 5 each are routed outwardly in the pin 3 flange. The flange is closed off at these locations by cap plates 17. The ends of the now twelve blind passages are connected by inclined connecting passages 4 in the pin flange from two peripheral drilled passages each. Thus every second of the 48 peripheral drilled passages is supplied with steam.

Instead of the orifices closed off by caps 17 on the inside of the pin 3 a ring-shaped passage my also be provided. This would then need to be closed off by a ring instead of the caps 17.

The connection of the neighboring drilled passages in each case, still awaiting a steam supply, is implemented in a way so that a connection is produced to the steam-laden neighboring drilled passages by passages 7 in the pin 8 at the drive end. The flow of stem required in the drilled passages connected thus first enters equivalently as excess steam through the neighboring drilled passage and then from the drive end. The amounts of steam are in relation to the cross-sections of the peripheral drilled passages so small that an adequate steam supply is possible at low steam velocities.

The discharge of condensate from the peripheral drilled passages occurs via a small syphon tubelet 9 each in the flange pin in the region of each end of the peripheral drilled passages 2. Thus a speedy and effective removal of the condensate is ensured. The mount of condensate remaining in the roll is exceptionally slight, especially when comparing this design to one of the usual stem-heated designs.

The condensate—together with a slight percentage of stripping or blow-through steam as the case may be—is forced by the steam pressure against the direction of centrifugal force radially towards the middle of the roll into ring-shaped receiver spaces 10 at both ends of the roll. These receiver spaces are connected with each other in distribution along the roll periphery by several axial-parallel drilled passages 11 in the roll body. Through these drilled passages 11 the condensate passes from the driven end of the roll back to its guide end. In this case, a few radial connecting tubes 12, again in the form of syphons, suffice to guide the condensate into a central condensate receiver 13 in the middle of the pin 3 at the operator end and from there through the double sealing head back out of the roll.

In addition, in the way as described, the interior 14 of the roll may be maintained free of steam and condensate. A drilled passage 15 directly open to the exterior from the interior of the roll through the pin flange ensures this. Accordingly, the roll body cannot be viewed as being a pressure vessel.

Figure 3:
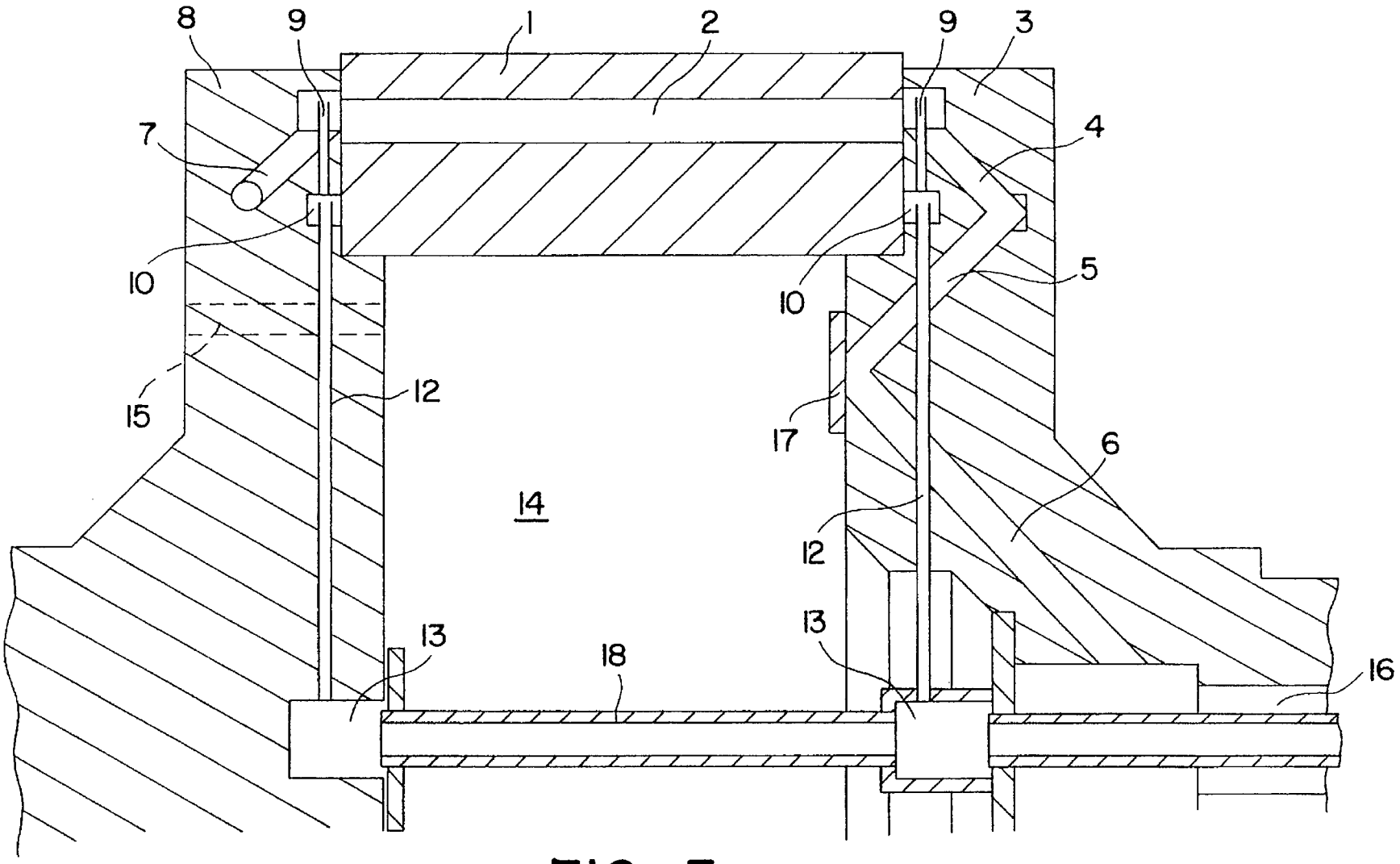
FIG. 3, is a longitudinal partial fragmentary view of a roll according to an alternate embodiment of the present invention.

FIG. 3, shows an alternate embodiment of the present invention wherein radial connecting tubes 12, are included in both pins or flanges 3 and 8. Tube 12 in flange 8 connects to a receiver 13 identical to the receiver 13 in flange 3 to receive the condensate. Receiver 13 in pin 3 and receiver 13 in pin 8 are interconnected by a passage 18 for removal of the condensate from the roll.

Figure 4:
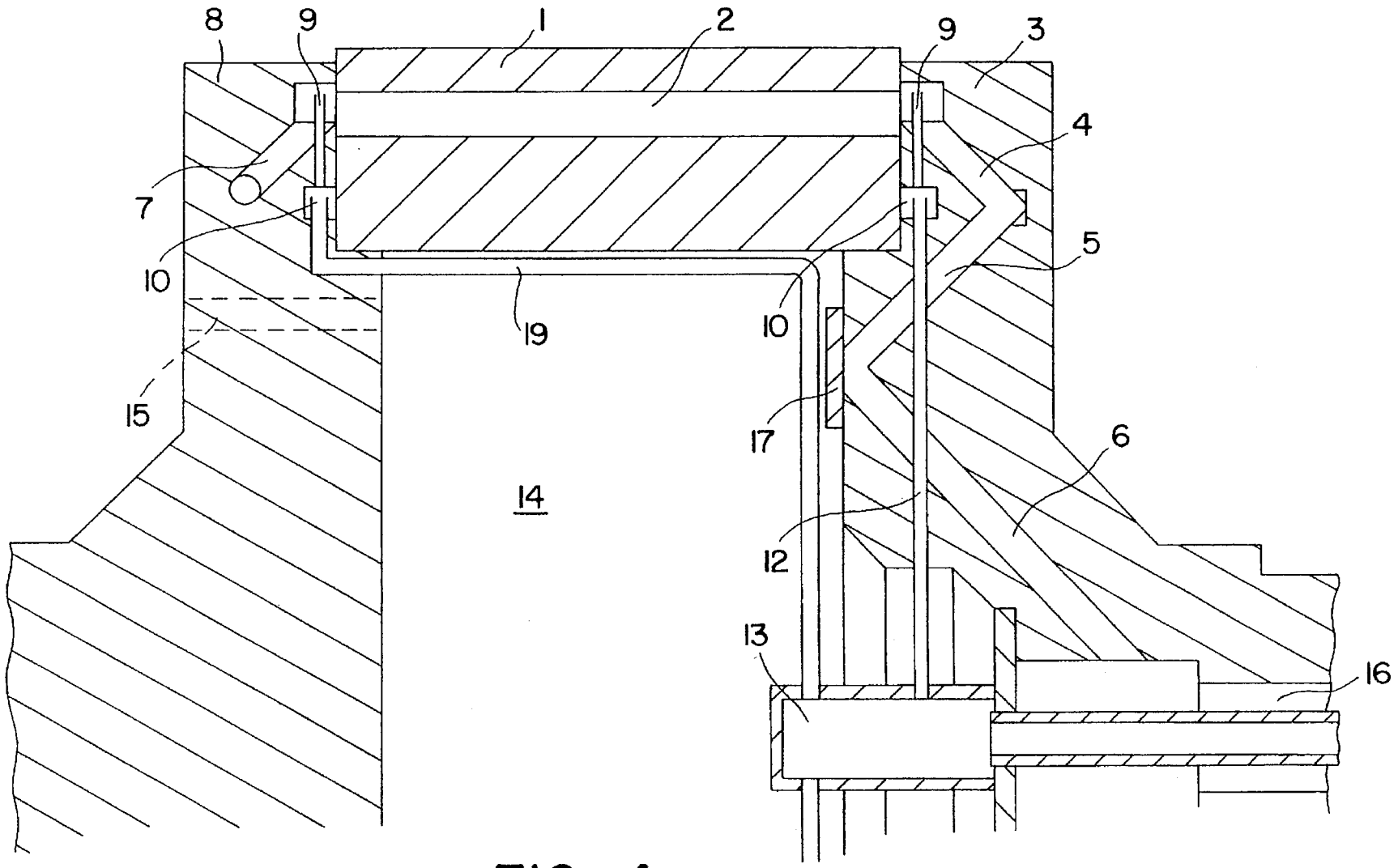
FIG. 4, is a longitudinal partial fragmentary view of a roll according to another alternate embodiment of the present invention.

FIG. 4, shows an alternate embodiment of the invention wherein a condensate passage 19 communicates with the receiver space 10 in pin 8 and conducts the condensate from receiver space 10 through the interior 14 of the roll to the condensate receiver 13 associated with pin 3.

The embodiments of FIGS. 3 and 4, eliminate the need for condensate return passages 11 drilled into the roll body.

Having thus described my invention what is desired to be secured by letters patent of the United States is set forth in the appended claims.

I claim:

1. In a steam-heated roll comprising:

a roll body (1) having;

a central bore (14) and peripheral axially parallel drilled passages extending through said roll body (2) for guiding the steam, and having at least one bolted-on flange pin (3) having a central bore (16) and connecting passage (4, 5, 6) between the central bore (16) of the flange pin (3) and the ports of the peripherally drilled passages (2) of the roll body (1) at the flange pin (16)

the improvement comprising:

said connecting passage (4, 5, 6) being multiply branched from said central bore (16) of said flange pin (3) in said flange pin (3) to one end of said peripheral drilled passages (2).

2. The stem-heated roll as set forth in claim 1, wherein said connecting passage (4, 5, 6) is disposed in said flange pin (3) of the roll at a guide end.

3. The steam-heated roll as set forth in claim 1, wherein said connecting passages 7 are disposed in a flange pin (8) of said roll at a drive end of said roll, the supply of the heating steam from a guide end of the roll to the drive end thereof being provided via a supply tube disposed centrally in the interior of the roll.

4. The steam-heated roll as set forth in claim 1 wherein said connecting passage (4, 5, 6) is branched from said central bore (16) in said flange pin (3) to every second peripheral drilled passage (2) whilst drilled passages located in between every second peripheral drilled passage are connected by passages (7) in a second flange pin (8) located at the opposite end of said roll.

5. The steam-heated roll as set forth in claim 1, wherein said connecting passage (4, 5, 6) is branched from the central bore (16) to four ports of said peripheral drilled passages (2).

6. The steam-heated roll as set forth in claim 1, wherein said connecting passage (4, 5, 6) comprises a first drilled passage (6) leading from the central bore (16) of said roll of said flange pin (3) to the central bore (14) of the roll, a plurality of second drilled passages (5) emanating from a port of said first drilled passage (6) at said roll body central bore (14) and incorporated in said flange pin (3), and in turn a plurality of drilled passages (4) connecting the ends of said second drilled passages (5) to a plurality of ports of said peripheral drilled passages (2), the port of said first drilled passage (6) being sealed off from said roll body (1) at the central bore (14) thereof.

7. The steam-heated roll as set forth in claim 1, wherein in a region proximate the ends of the peripheral drilled passages (2) in said flange pin at least one ring-shaped receiver space (10) is provided for condensate occurring in said drilled passages (2) and any stripping or blow-through steam.

8. The steam-heated roll as set forth in claim 7, wherein receiver spaces are provided at both ends of the roll body (1).

9. The steam-heated roll as set forth in claim 7 wherein syphons (9) connect every receiver space (10) for discharging the condensate and any stripping or blow-through steam received therein to the port regions of the peripheral drilled passages (2) at the ends thereof.

10. The steam-heated roll as set forth in claim 8, wherein said receiver space (10) in said flange pin (8) is connected by axially parallel return drilled passages (11) to said receiver space in the flange pin (3).

11. The steam-heated roll as set forth in claim 7, wherein said receiver space (10) of said flange pin (3) for discharging the condensate and any stripping or blow-through steam is connected via radial passages (12) to a receiver space (13) in the center of said flange pin (3) which, in turn, is connected to the outside of the roll.

12. The steam-heated roll as set forth in claim 1, wherein an open connecting drilled passage (15) through a flange pin connects said central bore (14) of the roll (1) to the environment so that ambient pressure exists in the central bore (14).

13. The steam-heated roll as set forth in claim 1, wherein for returning condensate from a drive-end flange pin a return tube is provided centrally disposed in the interior of the roll.

14. The steam-heated roll as set forth in claim 3, wherein supply and return tubes for steam and condensate are centrally disposed in an interior portion of the roll are configured as a concentric arrangement of tubes.

15. The steam-heated roll as set forth in claim 2, wherein said connecting passage (4, 5, 6) is branched from said central bore (16) in said flange pin (3) to every second peripheral drilled passage (2) whilst drilled passages located in between every second peripheral drilled passage are connected by passages (7) in a second flange pin (8) located at the opposite end of said roll.

16. The steam-heated roll as set forth in claim 3, wherein said connecting passage (4, 5, 6) is branched from said central bore (16) in said flange pin (3) to every second peripheral drilled passage (2) whilst drilled passages located in between every second peripheral drilled passage are connected by passages (7) in a second flange pin (8) located at the opposite end of said roll.

17. The steam-heated roll as set forth in claim 2, wherein said connecting passage (4, 5, 6) comprises a first drilled passage (6) leading from the central bore (16) of said roll flange pin (3) to the central bore (14) of the roll, a plurality of second drilled passages (5) emanating from the port of said first drilled passage (6) at said roll body central bore (14) and incorporated in said flange pin (3), and in turn a plurality of drilled passages (4) connecting the ends of said second drilled passages (5) to a plurality of ports of said peripheral drilled passages (2), the port of said first drilled passage (6) being sealed off from said roll body (1) at the central bore (14) thereof.

18. The steam-heated roll as set forth in claim 3, wherein connecting passage (4, 5, 6) comprises a first drilled passage (6) leading from the central bore (16) of said roll flange pin (3) to the central bore (14) of the roll, a plurality of second drilled passages (5) emanating from the port of said first drilled passage (6) at said roll body central bore (14) and incorporated in said flange pin (3), and in turn a plurality of drilled passages (4) connecting the ends of said second drilled passages (5) to a plurality of ports of said peripheral drilled passages (2), the port of said first drilled passage (6) being sealed off from said roll body (1) at the central bore (14) thereof.

19. The steam-heated roll as set forth in claim 2, wherein receiver spaces are provided at both ends of the roll body (1).

20. The stem-heated roll as set forth in claim 3, wherein receiver spaces are provided at both ends of the roll body (1).

* * * * *

UNITED STATES PATENT AND TRADE MARK OFFICE

CERTIFICATE OF CORRECTION

PATENT NO. : 5,655,596
DATED : August 12, 1997
INVENTOR(S) : Heinz-Michael Zaoralek It is certified that error appears in the above-identified patent and that said Letters Patent is hereby corrected as shown below:

Title page, item [73], delete "GambH" and substitute therefor --GmbH--.

In column 7, line 52, change "stem-heated" to --steam-heated--.

In column 10, line 11, change "stem-heated" to --steam-heated--.

Signed and Sealed this

Thirty-first Day of March, 1998

Bruce Lehman

*Attest:*

BRUCE LEHMAN

*Attesting Officer*

*Commissioner of Patents and Trademarks*